US011260501B2

(12) United States Patent
Junker

(10) Patent No.: US 11,260,501 B2
(45) Date of Patent: Mar. 1, 2022

(54) METHOD AND GRINDING MACHINE FOR MEASURING AND PRODUCING A TARGET OUTER CONTOUR OF A WORKPIECE BY MEANS OF GRINDING

(71) Applicant: ERWIN JUNKER GRINDING TECHNOLOGY A.S., Melnik (CZ)

(72) Inventor: Erwin Junker, Buehl/Baden (DE)

(73) Assignee: ERWIN JUNKER GRINDING TECHNOLOGY A.S., Melnik (CZ)

( * ) Notice: Subject to any disclaimer, the term of this patent is extended or adjusted under 35 U.S.C. 154(b) by 201 days.

(21) Appl. No.: 15/104,362

(22) PCT Filed: Dec. 18, 2014

(86) PCT No.: PCT/EP2014/078469
§ 371 (c)(1),
(2) Date: Jun. 14, 2016

(87) PCT Pub. No.: WO2015/091800
PCT Pub. Date: Jun. 25, 2015

(65) Prior Publication Data

US 2016/0311077 A1 Oct. 27, 2016

(30) Foreign Application Priority Data

Dec. 19, 2013 (DE) ..... 10 2013 226 733.9

(51) Int. Cl.
*B24B 49/04* (2006.01)
*B24B 5/42* (2006.01)
*B24B 49/02* (2006.01)

(52) U.S. Cl.
CPC ..... *B24B 49/04* (2013.01); *B24B 5/42* (2013.01); *B24B 49/02* (2013.01)

(58) Field of Classification Search
CPC ..... B24B 49/04; B24B 5/42; B24B 49/02; B24B 49/045; G05B 19/4163
See application file for complete search history.

(56) References Cited

U.S. PATENT DOCUMENTS 2,329,382 A * 9/1943 Blazek ..... B24B 5/421 12/142 F
3,271,910 A * 9/1966 Haisch ..... B24B 5/42 451/1

(Continued)

FOREIGN PATENT DOCUMENTS

DE 4423422 A1 1/1996
DE 19650155 C1 6/1998

(Continued)

*Primary Examiner* — Joel D Crandall
(74) *Attorney, Agent, or Firm* — Marshall, Gerstein & Borun LLP

(57) ABSTRACT

A grinding machine and a method for measuring and producing a target outer contour is disclosed, particularly for a pin-bearing journal of a crankshaft. First, a measurement device acquires measurement values for the dimensions and shape of a workpiece in at least two measurement planes that are spaced apart and extend transversely to a longitudinal extension of a workpiece region. The measurement planes are produced by a relative movement of the workpiece region and the measurement device in a Z axis direction, relative to the movement of a grinding disc in the direction of the Z-axis thereof. These measurement values are transmitted to a CNC system for advancing a grinding disc, such that any deviations from the target contour that may be present are corrected, and the target contour of the workpiece region in question is ground adaptively on the basis of the measurement values.

19 Claims, 6 Drawing Sheets

(56) References Cited

U.S. PATENT DOCUMENTS

| | | | | |
|---|---|---|---|---|
| 5,150,545 | A * | 9/1992 | Esteve | B23Q 1/36 33/501.02 |
| 5,857,895 | A * | 1/1999 | Falchieri | B24B 5/42 451/25 |
| 6,430,832 | B1 * | 8/2002 | Dall'Aglio | B24B 5/42 33/555.1 |
| 6,568,096 | B1 | 5/2003 | Svitkin et al. | |
| 6,729,936 | B1 * | 5/2004 | Hori | B24B 5/42 451/49 |
| 6,931,749 | B2 * | 8/2005 | Dall'Aglio | B24B 5/42 33/555.3 |
| 7,376,482 | B2 * | 5/2008 | Ido | B24B 5/02 451/251 |
| 8,978,879 | B2 | 3/2015 | Fourney | |
| 10,092,994 | B2 | 10/2018 | Junker | |
| 2003/0056386 | A1 | 3/2003 | Daniell et al. | |
| 2006/0014473 | A1 | 1/2006 | Ammi | |
| 2010/0105059 | A1 | 4/2010 | Maus | |
| 2011/0195635 | A1 * | 8/2011 | Himmelsbach | B24B 5/01 451/5 |
| 2011/0237159 | A1 * | 9/2011 | Araki | B23Q 17/20 451/5 |
| 2014/0083162 | A1 * | 3/2014 | Seewig | B24B 49/045 73/1.79 |

FOREIGN PATENT DOCUMENTS

| | | | |
|---|---|---|---|
| DE | 69708858 | T2 | 4/2002 |
| EP | 1263547 | B1 | 12/2007 |
| GB | 2290996 | A | 1/1996 |
| JP | 2010105059 | A | 5/2010 |
| SU | 1215965 | A1 | 3/1986 |
| WO | WO-9521728 | A1 | 8/1995 |
| WO | WO-9740432 | A1 | 10/1997 |
| WO | WO-0166306 | A1 | 9/2001 |
| WO | WO-2012126840 | A1 | 9/2012 |

* cited by examiner

FIG. 1(StdT)

METHOD AND GRINDING MACHINE FOR MEASURING AND PRODUCING A TARGET OUTER CONTOUR OF A WORKPIECE BY MEANS OF GRINDING

CROSS-REFERENCE TO RELATED APPLICATIONS

This is the United States National Phase of International Patent Application No. PCT/EP2014/078469, filed Dec. 18, 2014, which claims priority to DE 102013226733.9, filed Dec. 19, 2013, the entirety contents of which are incorporated by reference herein.

TECHNICAL FIELD

The invention relates to a method for measuring and producing an outer contour of at least one region of a workpiece by grinding, as well as a grinding machine for carrying out said method.

BACKGROUND

In-process measurements are known as a manner of continuously measuring workpiece regions directly during machining, i.e., in particular, even during grinding, with corresponding adaptive control of the grinding process on the basis of the current measured workpiece dimensions.

In particular, measurement devices—for example, those of the companies Marposs S.p.A. or JENOPTIK Industrial Metrology Germany GmbH—are used when shaft parts and, in particular, bearing points on crankshafts are being ground.

DE 694 13 041 T2 also discloses a measurement sensor of the company Marposs S.p.A. for controlling linear sizes. That measuring device, disclosed in order to measure inner diameters of holes as well as outer diameters, has a movable sensor in the form of a spherical element, wherein an additional element that transfers deflections to the spherical element is provided. Therewith, the workpiece is measured with respect to the diameter thereof in a contact region on the outer or inner surface, which lies essentially in a plane perpendicular to the longitudinal direction of the component to be measured. With the known measuring device, the spherical element is in contact with an abutment surface over which the element is movable in the oblique direction, wherein the abutment surface is concave in the cross-section thereof, this concavity serving as a seat for the spherical element and guiding the same in the oblique direction. The measurement plane of the diameter to be measured is defined as a reference position.

DE 33 36 072 C2—which was also filed by the company Marposs S.p.A.—also describes a sensing device for measuring linear dimensions. Here, too, known sensing heads measure external dimensions as well as internal dimensions in one plane, perpendicular to the longitudinal axis of the finished workpiece section to be measured. There is no description of measurement of shape deviations, such as, for example, circularity defects.

The prospectus "MOVOLINE In-Prozess-Messtechnik" of the company Jenoptik describes an in-process measurement technique for measuring the larger dimensions of machined workpiece regions, including continuously measuring these dimensions in order to adaptively control the grinding process on the basis of the measured workpiece parameters, as well as optionally using these measurement devices in order to control the circularity, wherein the latter is measured at the end of the machining process (see the measurement systems DF500 or DF700, p. 15). With this known measurement system, there is also a description of working with two measuring heads in the sense of an in-process measurement in order to determine outer diameters. However, even here the shape dimensions are taken after completion of the grinding or after completion of a grinding process step, but are not used for adaptive control.

For the ever-increasing requirements for precision, especially in the grinding industry—for example, in the production of crankshafts, including bearings thereof—it is no longer only necessary to pay attention to having the greatest precision in achieving the required target dimensions in the smallest possible tolerance range, but rather it is also necessary to minimize shape deviations in, for example, the circularity of the workpiece region to be ground, in particular, a bearing point of a centric crankshaft bearing. This requirement applies especially in the manufacture of high-precision shaft sections.

The aforementioned known technical approaches have a problem in that the measurements of, in particular, the diameter of the workpiece regions to be ground preferably always take place in the middle of the grinding disc, which also corresponds to the middle of the bearing point to be ground or the workpiece region. The place of the measurement at a certain point is called a measurement track—that is, in the case described, the measurement track is located in the middle of the grinding disc in the axial direction, as seen over the grinding disc width. If, for example, lubrication holes are to be provided in the grinding region, or if the use of steady rests during grinding is intended, then the measurement track is also arranged off-center, i.e., it is measured off-center.

When the circularity or circularity defects are measured after the grinding with the known systems, then at least the current workpiece is not affected any further. The known and described measurement systems do not deliver sufficiently precise measurement results on the basis of which high-precision grinding results could be obtained if a workpiece region to be ground deviates from the cylindricity or if this region is to be deliberately ground into a cone, crown, or concavity, because the measurement values are only measured in a measurement track.

GENERAL DESCRIPTION

The present invention addresses the problem of providing a method and grinding machine by means of which both the dimensions and shape of a workpiece to be ground can be detected during the grinding, via in-process measurement, and the target shape can be adaptively corrected on the basis of these detected measurement values.

This problem is solved by a method having the features according to claim 1, and by a grinding machine having the features according to claim 13. Advantageous developments are defined by the respective dependent claims.

According to the invention, with the method, a target outer contour of at least one region of a workpiece—in particular, a crankshaft—is measured with regard to dimensions and shape, and also produced with regard to dimensions and shape through longitudinal or plunge grinding by means of a grinding disc on a grinding center, with a computerized numerical control (CNC) system. Therewith, first, an actual contour on the workpiece or workpiece region is measured. A measurement device detects the measurement values of the dimensions and the shape, namely, in at least two measurement planes that are spaced apart from one another, extend transversely to the longitudinal extension of the respective workpiece region, and are located in the grinding disc engagement region. The at least two measurement planes are produced by a relative movement of the workpiece region and the measurement device in the Z axis direction, relative to the movement of the grinding disc in the direction of the Z-axis thereof. This means that on the one hand, the measurement device can be moved on the workpiece region to be ground in the axial direction of the longitudinal extension thereof, namely, when the grinding disc is fixed, but also means on the other hand that it is also possible for the measurement device to be fixed and for the workpiece to be moved relative to the measurement device. The grinding disc itself may then be moved in the Z-axis direction along the workpiece region to be ground; it is also possible, however, to use a grinding disc of such a width that the entire workpiece region to be ground can be ground for the purpose of plunge grinding, without movement of the grinding disc in the Z-axis direction thereof. The measurement values of the dimensions and shape of the ground workpiece region on the at least two measurement planes are transmitted to the CNC system. This CNC system is controlled on the basis of these measurement values in such a manner that any deviations from the target contour that may be present—namely, with regard to dimensions and shape—are corrected, and the target contour of the workpiece region in question is ground adaptively on the basis of the measurement values that were acquired for the particular measurement planes of a workpiece region. Adaptive grinding should be understood here to mean that for the purpose of in-process measurement, both the dimensions and the shape of the workpiece region to be ground are measured continuously or at intervals, and input into the control device, wherein the control device is configured so as to be adaptively adjustable on the basis of these measurement values, both with regard to the dimensions and with regard to the shape, such as, for example, the circularity of the workpiece section to be ground. This ensures that the quality of the workpiece region to be ground with regard to dimensions and also shape—in particular, circularity—is significantly better than what can be produced with the known grinding and measurement methods.

Thus, with the method according to the invention, the measurement track is adjusted during the grinding over the grinding disc width in the axial direction so that the entire outer contour can be detected during the grinding and so that the measurement values corresponding thereto can be inputted into the control device in order to advance the grinding disc such that the shape deviations can thus be continuously corrected, i.e., automatically compensated.

The method according to the invention is especially applicable to pin-chasing grinding, which is used to grind, in particular, the pin bearings of a crankshaft. The pin bearing can now be ground first in the context of in-process measurement with regard to the diameter and shape of the bearing, as well as with regard to shape tolerances and the shape—for example, cylindricity, conicity, or deviations therefrom—or a crowned or concave shape of the respective bearing journal, namely, as measured over the bearing width. In order to achieve the most precise target contour possible, adaptive grinding realized in a plurality of measurement tracks on the basis of the acquired measurement values is also used when the pin bearings are being ground.

In a preferred embodiment, in which the measurement device moves in the Z-axis direction relative to the grinding workpiece, the measurement device is thus automatically displaced in relation to the width of the grinding disc, i.e., in relation to the geometric longitudinal axis of the workpiece to be ground. The number of the measurement tracks or measurement planes to be used on the workpiece to be ground depends on the required precision and also on the target shape of the outer contour to be measured.

Preferably, deviation from the shape—such as circularity, cylindricity, conicity, crowning, and/or concavity—is measured through two measurement planes spaced apart as widely as possible on the workpiece region; further preferably, the measurement planes are adjusted steplessly over the entire measurement region. This is advantageous in that the number of the measurement planes to be measured, or the distance thereof from one another, can be optionally set for any measurement task and for any target contour. In order to reliably determine the crowning or concavity on shaft sections, measurements in at least three measurement planes are provided.

Further preferably, the measurement device is stationary on the grinding spindle head, relative thereto in the X-direction, and is arranged so as to be displaceable in the Z-direction relative thereto; the grinding spindle head is also displaceable in the Z-axis direction, such that here, too, the respectively desired measurement planes or measurement tracks can be individually and steplessly adjusted in accordance with the precision and the target outer contour to be ground.

Preferably, the measurement device is moved by means of an electric drive, which is preferably controlled in a freely programmable manner. Freely programmable control endows the measurement device—and, therewith, the flexibility of the method according to the invention—with a high degree of freedom, forming the basis for use on the most diverse target outer contours to be ground.

Preferably, however, it is also possible for the measurement device to be hydraulically or pneumatically moved in the Z-direction. The use of a hydraulic or pneumatic drive device for moving the measurement device or the use of a freely programmable electric drive depends on the respective purpose of use, and on the available budget for the machine on which the method according to the invention is realized.

Preferably, measurements are taken during the grinding, as is the case with in-process measurement. Preferably, such in-process measurement takes place during the finish grinding. However, it is also possible that the advance of the grinding disc is interrupted for the purpose of measurement, and the grinding process continues after successful measurement, wherein the grinding disc remains in the hold position thereof until the measurement process is complete. It is also possible to first acquire the measurement values in the at least two measurement planes after the finish grinding, assess the overall measured contour of the workpiece, and take the results into account when grinding the next workpiece, optionally then with a correction for the contour incorporated into the control, by means of the CNC of the grinding disc.

Often, in particular, for bearing journals, it is required that the target outer contour deviate slightly from an ideal cylindrical shape. Generally, such shape deviation is determined by the intended use of the component, in terms of load and lubrication.

With such relatively low deviation from cylindricity, this deviation is produced by tilting the grinding disc in a horizontal plane about a CNC-controlled axis. The horizontal plane then runs horizontal to the central axis of the workpiece. With the method according to the invention, in such a case, measurements are taken in such a number of measurement planes in the longitudinal extension of the workpiece region to be ground that the target outer shape can be determined with the required high precision, and correspondingly the grinding disc is controlled via CNC thereof in order to produce this target outer shape with regard to the advance thereof onto the workpiece region. The target shape of the workpiece region is generally ground by a grinding program entered into the CNC system, wherein the grinding program is adaptively adjusted as a result of the measurement of the target outer shape, which means that corrections or correction functions are entered into the grinding program so as to make it possible to further reduce defects that would otherwise arise or overlap during the grinding.

Preferably, it is also possible to produce the target shape of the workpiece region to be ground, by means of a grinding disc that has been previously dressed so as to correspond to the desired target shape, the workpiece region being ground in a corrected manner by again dressing the grinding disc. This means that the method according to the invention can also be used with a dressing wheel, so that even regular high-precision dressing of the grinding disc makes it possible to achieve corresponding precision with regard to dimensions and shape on the workpiece region to be ground, in a manner that represents a significant improvement or increase with regard to the precision relative to the prior art.

The method according to the invention thus makes it possible not only to exactly measure the cylindricity, conicity, or crowned or concave shape of a bearing, in particular, of a crankshaft over the bearing width on the grinding machine during the grinding, but also to directly correct same by targeted, adaptive intervention and correction via the grinding program. With the known methods, it has been necessary to first externally measure the crankshaft for this purpose. On the finish-ground workpiece, these shape deviations could also no longer be corrected without the bearing point then being ground, for example, so small that the crankshaft has to be rejected.

This disadvantage is all the more at play when the crankshafts have large dimensions, which is often the case with crankshafts for truck engines or stationary diesel engine aggregates. In particular, when large crankshafts are being ground, the requirements for the cycle time when the crankshafts are produced are not as critical as with smaller components.

This makes it possible to increase the number of measurements that can be performed in a plurality of measurement planes, precisely as in the present invention, which does indeed increase the machining times slightly, but also contributes to significantly increasing the quality of the finished component. Nonetheless, the price of these, in particular, large crankshafts is already relatively high after prefabrication, and amounts to several hundred or several thousand euros. The method according to the invention thus is ever more important with more expensive and elaborate production of the raw components in the machining steps before the grinding. In particular, this applies to the production of special crankshafts in small batch sizes.

According to the preferred embodiments of the method according to the invention, the components to be ground can be given high quality and tight dimensional and shape tolerance by:

- dressing the grinding disc with regard to desired special cylindrical shape, conicity, crown, or concavity;
- providing a CNC-controlled B-axis by tilting the grinding disc in the horizontal plane, to the central axis of the crankshaft longitudinal axis, in particular, in order to achieve a cylindrical shape or conicity;
- providing a so-called CNC-controlled "mini-B-axis" by tilting the grinding disc in the horizontal plane, to the central axis of the crankshaft longitudinal axis in low tilt angles for a low conicity, crowning, or concavity (in particular, see the application with the application number WO 2012 126 840 A1 of the same applicant) deviating from the cylindrical shape; and
- the special grinding program, adapted to the method according to the invention for measurement in a plurality of measurement tracks or measurement planes.

According to another aspect of the present invention, a grinding machine according to the invention is provided, on which the method according to any of claims 1 to 12 is carried out. This grinding machine according to the invention comprises a measurement device by means of which the dimensions and shape—such as diameter or circularity—of workpiece regions of a workpiece—in particular, a crankshaft—around a center are measured and produced with a central longitudinal axis. This grinding machine comprises a grinding disc that is mounted in a grinding spindle head and grinds with simultaneous advance in the direction of the X-axis thereof. An "X-axis" typically refers to the movement of the grinding disc, preferably at right angles, relative to the longitudinal extension of the workpiece region to be ground. The measurement device associated with the grinding machine according to the invention is arranged on the grinding spindle head and configured so that a sensor can be pivoted to bear onto the workpiece region, wherein the measurement device, the sensor implementing the actual measurement, or the sensing element forms measurement planes that are arranged transversely to the longitudinal axis of the workpiece region, and that can be arranged at any position in the direction of the workpiece longitudinal central axis in a manner corresponding to the movement of the measurement device or the sensor in this direction, for the purpose of measurement. It shall be readily understood that it is also possible that the measurement device is fixedly arranged, whereas a workpiece spindle head covering the workpiece can be moved in the Z-direction. Such a grinding machine according to the invention makes it possible to measure the ground workpiece regions during the grinding, namely, with regard to the dimensions and shape thereof, and simultaneously to adaptively—i.e., correctively—influence the advance of the grinding disc—i.e., the X-axis advancement thereof in the event of any deviations from the target contour that may be present. This significantly improves the precision of the ground workpiece.

Preferably, the measurement device has (or the sensor thereof is in the form of) two measurement surfaces arranged in the manner of a prism. During measurement, these measurement surfaces each contact the workpiece region at the contact region in a defined distance from one another. The measurement surfaces are therewith arranged on the legs of the prism, one measurement surface being provided on each leg. The actual sensing element for measurement is arranged in the middle part of the prism between the measurement surfaces. The measurement device is displaced to the contact region by means of a hydraulic, pneumatic, or electric drive. Preferably, this entails a CNC-controlled measurement device that is arranged on the grinding spindle head so as to be able to realize a defined contact position, and thus highly-precise measurement.

The grinding disc used to grind the workpiece region preferably has a width that corresponds approximately to the length of the workpiece region. With such a constellation or such a wide grinding disc, the grinding disc is advanced and thereupon grinds the workpiece region to be ground essentially by plunge grinding, without the grinding disc needing to be displaced in the direction of the Z-axis thereof in order to grind the respective shaft section.

According to another embodiment, the grinding disc is configured with a width that is smaller than the axial length of the workpiece region to be ground, wherein in such a case, the grinding disc carries out longitudinal grinding along the axis of rotation thereof over the axial longitudinal direction of the workpiece region to be ground, and is thus moved along the Z-axis thereof during the grinding.

Further preferably, the grinding machine comprises a measurement device configured such that the measurement planes of the respective workpiece region—in particular, a pin bearing journal, on which measurements are being taken—make it possible to determine a conical, crowned, or concave shape of the workpiece region and produce said shape on the basis of the measurement values.

BRIEF DESCRIPTION OF THE DRAWINGS

More advantages, possible uses, and specific embodiments shall now be explained in greater detail, with reference to the accompanying drawings.

DETAILED DESCRIPTION OF THE DRAWINGS

Figure 1:
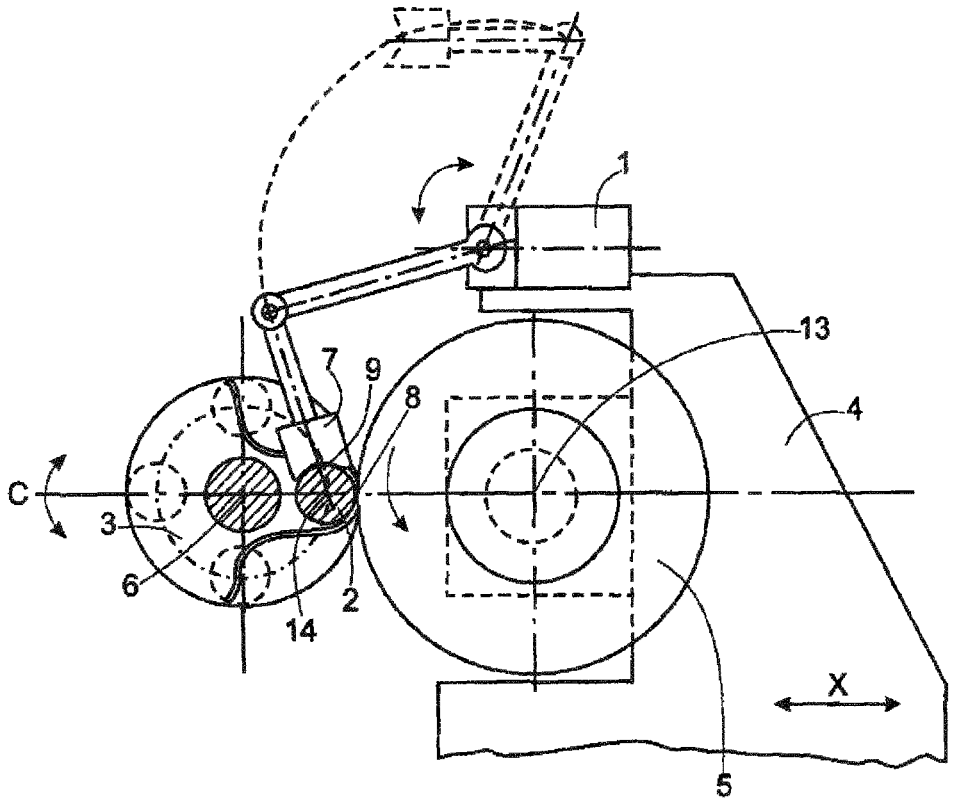
FIG. 1 illustrates a principal side view of an assembly for grinding a pin bearing in pin-chasing grinding with a measurement device for measuring the diameter of a pin bearing journal according to the prior art.

FIG. 1 illustrates a principal depiction of an assembly, which illustrates the pin-chasing grinding of a pin bearing journal 2 by means of a grinding disc 5 performing a pin-chasing movement. A grinding spindle head 4 bears, on an upper region thereof relative to the grinding disc 5, a measurement device 1 that can be moved in dotted lines from a measurement arm—which is applied against the pin bearing journal 2 of the crankshaft 3 that is to be measured—in a manner corresponding to the solid lines into a withdrawn position in which measurements are not taken. The grinding disc 5 with the axis of rotation 13 thereof can be advanced onto the pin bearing journal to be ground in a controlled manner over a CNC-controlled X-axis. The axis of rotation 13 of the grinding disc is also called the C-axis, and is also CNC-controlled. The elements required to realize movement in the X-axis direction are built in a known manner on a machine bed (not shown), as is the workpiece spindle head with the C-axis thereof (also not shown separately). The grinding is performed by an interpolating grinding method via corresponding adjustments to the CNC-controlled X- and C-axes.

The pivotable measurement system 1 illustrated in FIG. 1 is arranged with the drive thereof on the grinding spindle head 4, and comprises an articulated arm, a measuring head 7 being arranged on the front end thereof. With the articulated arm of the measurement device 1, the measuring head 7 can be placed against the outer contour of the depicted pin bearing journal 2 in order to measure the dimensions thereof. During the grinding against the grinding disc engagement region 8, the crankshaft 3 also rotates about the center 6 thereof, and the grinding disc 5—performing pin-chasing grinding—follows the eccentric movement of the pin bearing journal 2 and remains in constant grinding engagement therewith during the entire grinding process. The illustrated measurement device 1 abuts with the sensor 7 against the contact region 9, and is thus able to measure the current diameter of the pin bearing journal 2, by means of the sensing element 15. If measurements are not to be taken—which is the case, for example, when a new crankshaft is loaded into the grinding machine or unloaded therefrom—then the measurement device has the articulated arm and sensor in a withdrawn position, which is depicted in the drawings by dotted lines.

The measurement device 1 is arranged fixedly on the grinding spindle head with regard to the X-axis thereof, so that when the grinding disc 5 is moved with the grinding spindle head 4 along the X-direction of the measurement device 1, the measurement device is also moved along.

Figure 2:
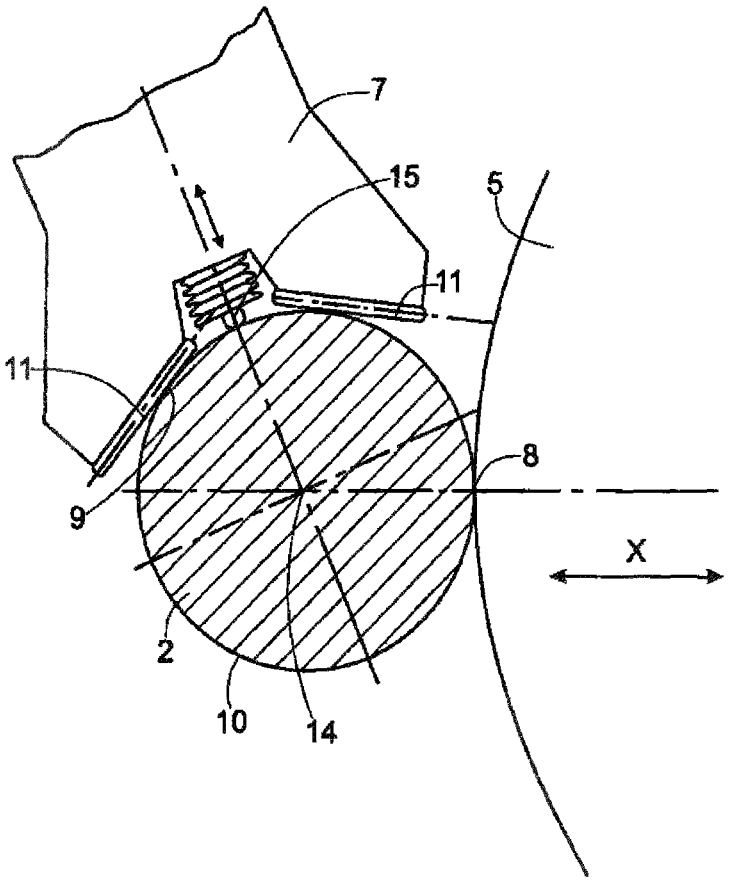
FIG. 2 illustrates an enlarged partial view of an assembly according to FIG. 1, at the measurement point of the pin bearing journal, during grinding and measurement at a bearing journal according to the prior art.

FIG. 2 depicts an enlarged partial view of the engagement of the grinding disc 5 with the grinding disc engagement region 8 on the pin bearing journal 2 to be ground, the longitudinal axis being denoted by "14". The target outer contour 10 of the pin bearing journal 2 is produced by means of the grinding disc 5. During the grinding, the measurement device 1 is placed with the measuring head 7 thereof—and the measurement surfaces 11 arranged thereon—against the contact region 9 of the pin bearing journal 2. The measurement surfaces 11 form a prism, which comes up against different diameters to be ground. The actual measurement device, which is arranged between the measurement surfaces 11, constitutes a linear measurement device and can be moved in the direction of the depicted double-headed arrow in accordance with the diameter to be measured or the contour to be measured of the pin bearing journal 2 to be ground. The advance of the grinding disc 5 against the pin bearing journal 2 is illustrated with the indicated X-axis. The prism-shaped measurement fork abuts with the two measurement surfaces 11—defined by bearing pins—on the workpiece against the component to be measured, i.e., against the surface thereof, in a prism-shaped bearing through a predetermined bearing force. The bearing pins are made of cemented carbide or diamond-coated material. The actual measurement device, which is arranged between the two bearing pins approximately in the middle of the V-shaped prism, is a measuring sensor by means of which the bearing point is measured.

Figure 3:
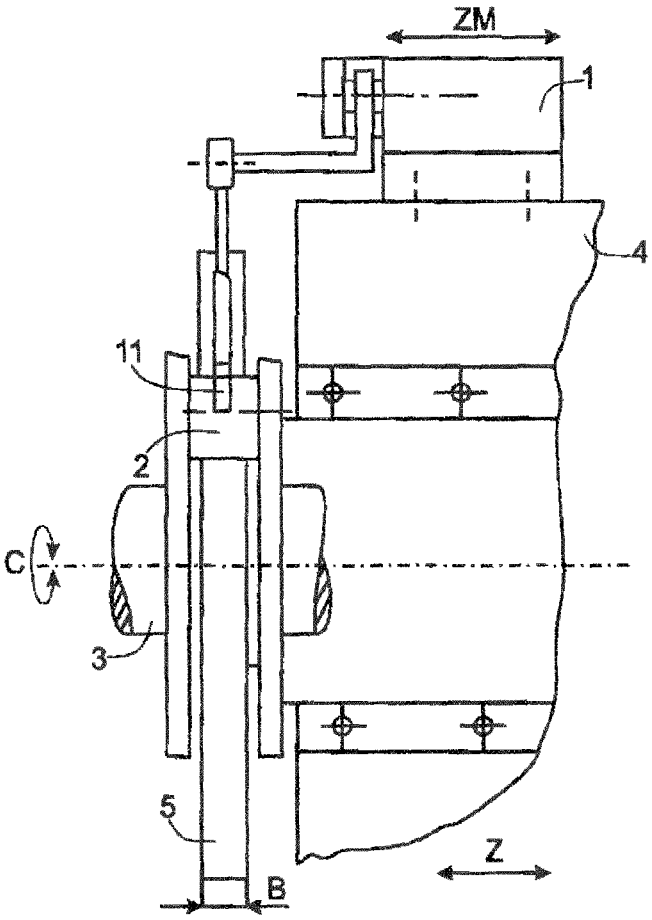
FIG. 3 illustrates a partial front view of the grinding spindle head during grinding of a pin bearing of a crankshaft with a measurement device according to the invention.

FIG. 3 depicts a partial front view of the grinding spindle head 4, when a pin bearing journal 2 of a crankshaft 3 is being ground. The crankshaft 3 is indicated by two main bearings, two crank webs, and a pin bearing 2 arranged between the two crank webs. The rotational movement of the crankshaft 3 is realized through the CNC-controlled C-axis. The grinding disc 5, having a width B, is engaged with the pin bearing journal 2 and is depicted during grinding thereof. The measurement device 1—which is placed with the measurement surfaces 11 thereof against the pin bearing journal 2 for the purpose of measurement—is depicted on the side of the pin bearing journal 2 that is displaced circumferentially to the engagement region 8 of the grinding disc 5. The measurement device 1 is mounted onto the grinding spindle head 4 by means of an adjusting carriage, and takes the same advancing movements of the X-axis of the grinding disc 5, which is mounted onto a grinding spindle. According to one embodiment of the invention, the measurement device 1 can be moved in the Z-direction by means of a CNC-controlled separate ZM-axis in a plurality of measurement planes on the pin bearing journal 2 to be measured (this being indicated by the double arrow over the measurement device 1). On the lower right in the drawing is the indication of the Z-axis for the grinding disc 5 or the grinding spindle head 4. The movement of the measurement device 1 in the Z-axis direction is realized by the depicted, autonomous, CNC-controlled ZM-axis.

In a conventional manner, the grinding disc 5 is advanced over the X-axis thereof, which is also CNC-controlled, against the pin bearing journal 2 to be ground. The Z-axis of the grinding spindle head 4 may either be arranged under the X-axis—in which case a cross slide construction (not shown) is preferably provided—or under the grinding table, in which case the grinding table is moved with the corresponding grinding table structures, such as a workpiece spindle head and tailstock (both not shown). These two embodiments are quite common in the construction of grinding machines.

According to the invention, it is important that a relative movement in the direction of the Z-axis or ZM-axis is provided between the workpiece—i.e., the crankshaft 3—and the grinding disc 5. This causes the measurement device 1 to take measurements in different measurement planes, so that the component to be measured can be precisely measured in a plurality of planes along the axis thereof, and also the complete target outer contour 10 can be measured, which has not been the case thus far with measurement devices and systems according to the prior art.

It is thus evident in FIG. 3 that the measurement device 1 can be automatically displaced axially parallel to the axis of rotation 13 of the grinding disc 5 during the grinding, i.e., during the grinding cycle, in any number of measurement planes that are spaced apart from one another and run perpendicular to the longitudinal axis 14 of the pin bearing journal 2. The direction for this movement is indicated by the designation "ZM".

The CNC-controlled ZM-axis is independent of the CNC-controlled Z-axis, and therefore, during the grinding, the measurement device 1 can automatically adjust, in the ZM-axis, the measurement plane on the pin bearing journal 2 being ground in parallel to the axis direction of the grinding disc 5 on the pin bearing journal 2. The measurement device 1 according to the invention thus makes it possible, even during the grinding, to conduct the measurements on the bearing point being ground—i.e., during the continuous grinding process, i.e., an in-process measurement method—with regard to the cylindrical shape, conicity, crown, or concavity, and to correct the advances of the grinding disc 5 through the grinding program during the grinding.

Thus, high-precision bearing points are produced with the method according to the invention, because the results of the in-process measurement with regard to dimensions and shape of the bearing point to be measured are inputted to the control device, and a corrected target outer contour 10 is produced on the basis of these measurement values. This results in a significantly higher quality of the ground workpiece regions, i.e., the bearing points of the crankshaft.

Figure 4:
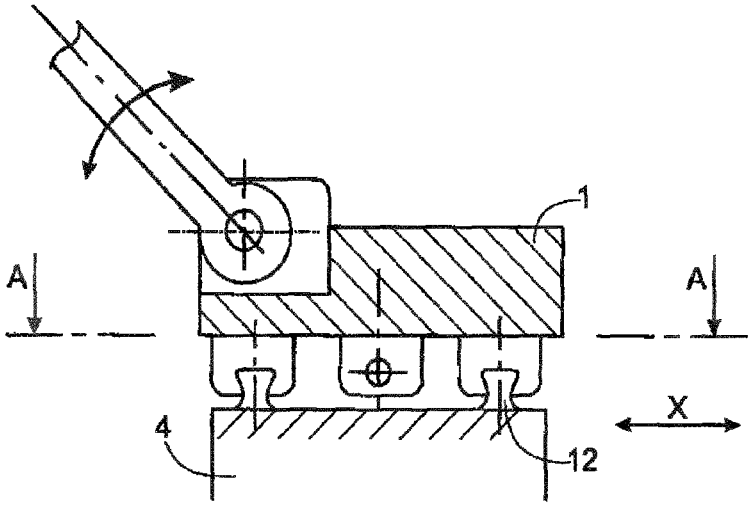
FIG. 4 illustrates a partial view with a guide rail for adjusting the measurement device in the direction of a ZM-axis according to the invention.

FIG. 4 depicts a partial section view of a rail guide of the measurement device 1, along the ZM-axis thereof. The ZM-axis is arranged perpendicular to the plane of the drawing. The double arrow and the "X" indicate that the X-axis takes place via the movement of the grinding spindle head 4, because the measurement device 1 is arranged fixedly on this grinding spindle head 4, and thus tracks the movements of the grinding spindle head 4 along the X-axis. FIG. 4 shows that the base plate of the measurement device 1 is mounted onto a guide by means of guide rails 12 on the grinding spindle head 4. The present case depicts a guide that is composed of two guide rails 12, each constructed of roller circulating shoes pre-tensioned without backlash. An axis drive is shown with a simplified depiction in the middle between the guide rails 12, by means of a ball roll spindle.

Figure 5:
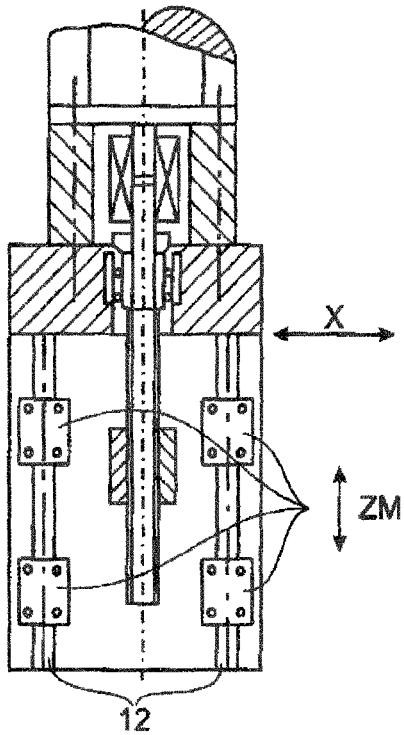
FIG. 5 illustrates a schematic depiction of the measurement device according to the invention, along a cutting plane A according to FIG. 4.

FIG. 5 depicts a sectional view through the measurement device 1 along the cutting plane A-A drawn in FIG. 4. The cutting plane is located below an adjusting plate (not shown), which receives the first pivot bearing of the pivot arm of the measurement device 1.

FIG. 5 illustrates a plan view of the two guide rails 12, with the associated roller circulating shoe. The roller circulating shoes are fixedly connected to the adjusting plate by a threaded connection. Depicted in the middle between the guide rails 12 is the adjusting drive, which in this case is a drive via a ball roll spindle (not shown in greater detail) that is separately mounted and is driven via a coupling to a CNC-controlled servomotor. Such a design of the displacement or movement of the measurement device 1 in the ZM-axis direction thereof is sufficiently stable and rigid to be able to automatically ensure a high-precision positioning of the measurement device 1 in connection with the CNC system in any defined number of measurement planes, arranged in accordance with the surface shape of the bearing journal to be ground, during the grinding process.

Figure 6:
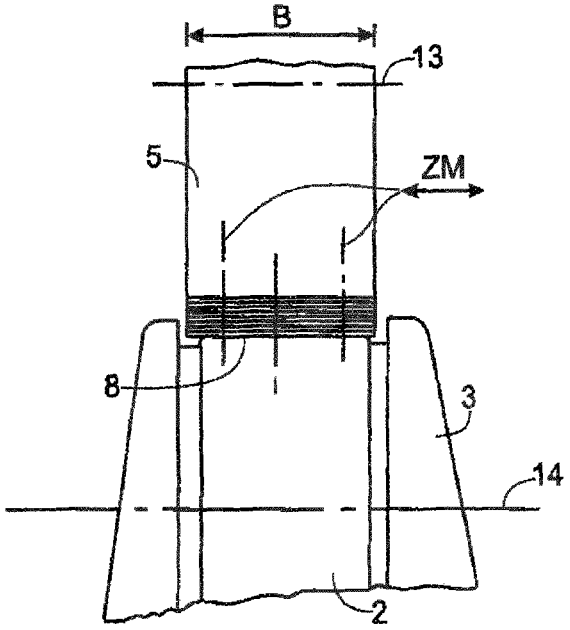
FIG. 6 illustrates a partial view of a grinding disc in engagement with a bearing point of a crankshaft with principal indication of two measurement planes according to the invention, spaced apart in the longitudinal direction of the bearing point.

FIG. 6 illustrates a pin bearing journal 2 of a crankshaft 3—indicated with two crank webs 3—that is being ground by means of a grinding disc 5 having a width B. The width B of the grinding disc 5 is so large that the length L of the pin bearing journal 2 to be ground can be ground by plunge grinding. In addition, the longitudinal axes 14—arranged parallel to one another—of the pin bearing journal and the axis of rotation 13 of the grinding disc 5 are drawn. In the grinding disc engagement region 8, the arrangement of three measurement planes of the measurement device (not shown) are depicted schematically, wherein the middle measurement plane is arranged between the two outer measurement planes, which are indicated by the double arrow ZM and delimit the measurement region. The adjustability of the measurement device 1 along the CNC-controlled ZM-axis thus makes it possible to steplessly shift the measurement plane in the entire region, which can be set depending on the design and dimensions through the configuration of the ZM-axis. The depicted pin bearing has undercuts on both sides of the actual pin bearing journal 2. However, plunge grinding in order to produce the target outer contour 10 of the pin bearing journal 2 may also been performed by way of plunge grinding in such a case, if transition radii are provided to both plan sides instead of the undercuts.

Figure 7:
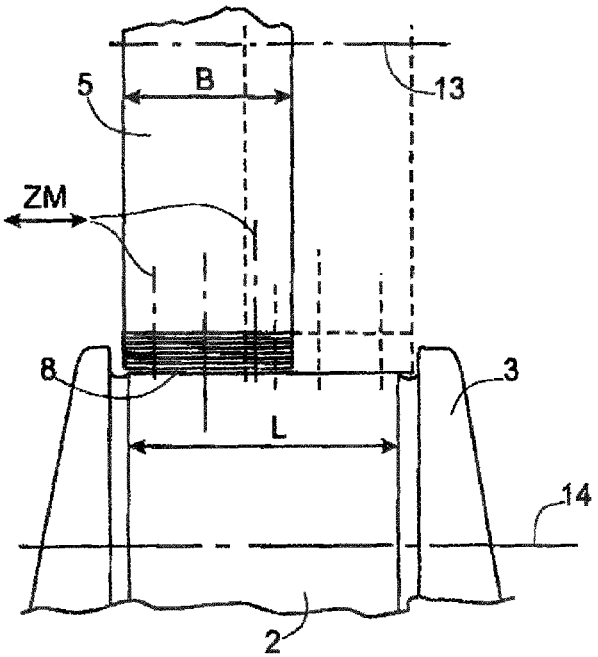
FIG. 7 illustrates a partial view of a bearing journal of a crankshaft during the grinding with a grinding disc of a lesser width than the length of the journal region, and different given measurement planes, spaced apart axially from one another.

FIG. 7 also illustrates a pin bearing (partially shown) with a pin bearing journal 2 between two crank webs (partially shown) of a crankshaft 3. The pin bearing journal 2, which has a pin bearing journal length L, is ground by means of a grinding disc 5 against the grinding disc engagement region 8. The width B of the grinding disc 5 is less than the pin bearing journal length L, so that the grinding disc 5 produces the target outer contour 10 of the pin bearing journal 2 by way of longitudinal grinding along the axis of rotation 13 thereof, which runs parallel to the longitudinal axis 14 of the pin bearing journal 2. By way of example, there are six different measurement planes depicted, which walk in the axial direction of the longitudinal axis 14 of the pin bearing journal 2 and two of which (by way of example) are indicated by means of the double arrow designated "ZM". The grinding disc 5 is then moved by way of longitudinal grinding from the left position—depicted in FIG. 7—to the rightmost position thereof, in which the grinding disc 5 is depicted with dashed lines. In principle, it is also possible to produce the target outer contour 10 of the pin bearing journal 2 by two plunge grinding processes where the grinding disc 5 has a width B as shown, instead of the aforementioned longitudinal grinding. If grinding is to be down with at least two plunge grinding processes, then the bearing point must be ground by two or more consecutive, side-by-side plunge grinding processes. The different measurement planes may be arranged over the entire width of the pin bearing and approached steplessly. The number of measurement planes in which a measurement process is performed during the grinding depends then on the precision of the target outer shape 10 to be achieved, as well as the shape thereof.

Figure 8:
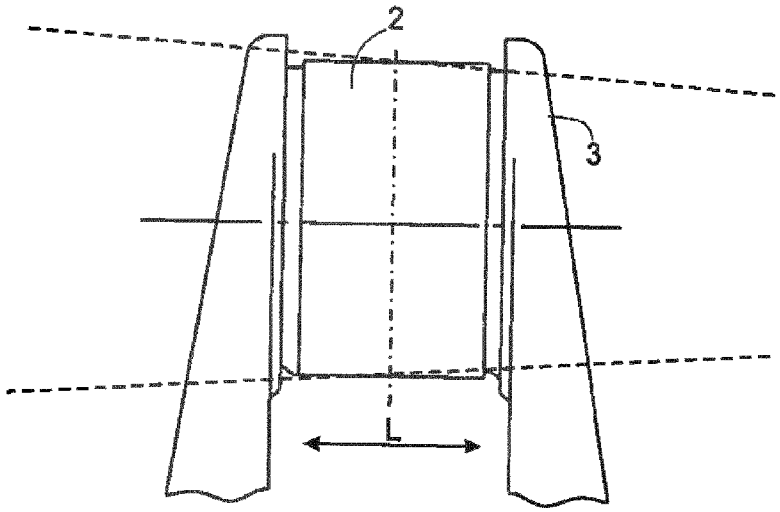
FIG. 8 illustrates a pin bearing journal of a crankshaft with an indicated conical target contour.

FIG. 8 shows a pin bearing having a pin bearing journal 2 between two crank webs (partially shown) of a crankshaft 3, which has a pin journal length L. The dashed lines are intended to illustrate what is meant by the conicity of a bearing journal in the context of the present application. First, a specially profiled or obliquely placed grinding disc grinds the conicity on the pin bearing journal 2, wherein the outer contour of the bearing journal can be produced in accordance with the width of the grinding disc or length of the pin bearing journal by way of plunge grinding, longitudinal grinding, or double disc grinding. A corresponding number of measurement planes and implementations of ongoing measurements during the grinding—i.e., implementation of so-called in-process measurement—makes it possible grind a highly precise conical shape of a bearing journal, without the need to wait until the end of the grinding—as was the case with the circumstances in the prior art—with measurement after the grinding to decide that the conical outer contour is too small relative to the target contour to be achieved, and thus that the entire crankshaft is not fit for purpose.

Figure 9:
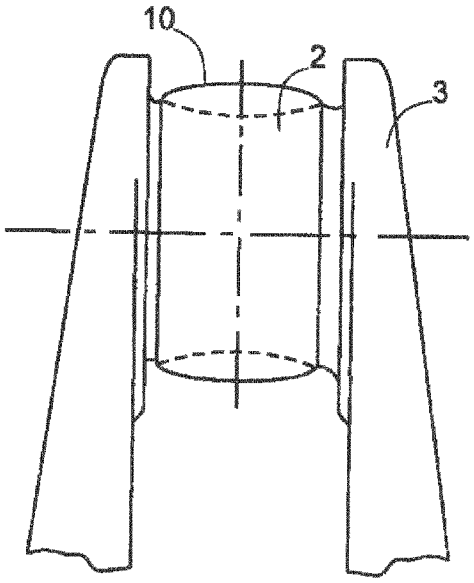
FIG. 9 illustrates a pin bearing journal with a crowned, convex, and indicated concave target outer contour.

The shape of a pin bearing journal 2 may also be crowned or concave, for load-related reasons or, for example, for lubrication-related reasons. This is depicted in FIG. 9, where the solid lines represent the crowned shape of the pin bearing journal 2 and the dashed shape represents a concave shape. The pin bearing journal 2 has undercuts in the transitions thereof to the crank webs of the crankshaft 3. The measurement method according to the invention, in connection with the grinding method by means of which measurement values obtained in-process are continuously inputted to the control unit in order to adjust the grinding disc, makes it possible to grind virtually any target outer contour 10 of a bearing journal, i.e., even a pin bearing journal 2, wherein a very high precision of the respective ground bearing journal can be achieved.

The invention claimed is:

1. A method for measuring and producing a target outer contour of at least one region of a workpiece with regard to dimensions and shape, through continuous and adaptive longitudinal grinding or plunge grinding by means of a grinding disc having an axis of rotation, on a grinding center, with a CNC system for the X-axis thereof, wherein:

a) an actual contour on the workpiece in the region being ground is measured during grinding of the at least one region of the workpiece;

b) measurement values of the dimensions and the shape in at least two measurement planes in the region being ground of the workpiece that are spaced apart from one another, extend transversely to the longitudinal extension of the respective workpiece region, and are located in a grinding disc engagement region are acquired during the adaptive grinding of the at least one region of the workpiece by means of a measurement device;

c) the measurement planes are produced during the continuous and adaptive grinding of the at least one region of the workpiece by a relative movement between the workpiece region and the measurement device in the Z-axis direction—which is configured along the axis of rotation in the longitudinal direction of a workpiece region to be ground—relative to the movement of the grinding disc in the direction of the Z-axis;

d) the measurement values are transferred to the CNC system; and e) the CNC system is controlled in such a manner that any deviations from the target contour that may be present in the at least one region of the workpiece are in-process corrected, and the target contour of the workpiece region in question is ground adaptively on the basis of the measurement values that were acquired for the particular measurement planes of a workpiece region during the adaptive grinding of that region.

2. The method according to claim 1, wherein the workpiece regions are measured with regard to circularity, cylindricity, conicity, crowning, and/or concavity along the distance of at least two measurement planes spaced apart on the workpiece region, the measurement planes being adjusted.

3. The method according to claim 1, wherein the workpiece is clamped so as to be stationary with respect to the longitudinal axis thereof, and the measurement device is moved in the direction of the longitudinal axis into the respective measurement plane.

4. The method according to claim 1, wherein the measurement device is arranged on a grinding spindle head, and is moved relative thereto in the direction of the Z-axis in order to take measurements in different measurement planes.

5. The method according to claim 1, wherein the measurement device is moved by means of a programmable electric drive.

6. The method according to claim 1, wherein the measurement device is moved hydraulically or pneumatically in the Z-direction.

7. The method according to claim 1, wherein measurements are taken during the grinding.

8. The method according to claim 1, wherein measurements are taken in an interrupted grinding disc advancement, and the grinding disc remains in a holding position during the measurement until the measurement has been made.

9. The method according to claim 8, wherein the measurement values are acquired after the grinding, the measured contour of the workpiece is assessed, and any required correction to the contour is performed by means of the CNC system of the grinding disc when the next workpiece is ground.

10. The method according to claim 8, wherein the target shape of the workpiece region to be ground is produced by means of a grinding disc that has been previously dressed so as to correspond to the desired target shape, the workpiece region being ground in a corrected manner by again dressing the grinding disc.

11. The method according to claim 1, wherein the target shape of the workpiece region to be ground is produced by pivoting the grinding disc in the horizontal plane about a CNC-controlled axis, the plane lying horizontal to the central axis of the workpiece.

12. The method according to claim 1, wherein the target shape of the workpiece region is ground through a grinding program that is input to the CNC system.

13. A grinding machine for measuring and producing a target outer contour of at least one region of a workpiece with regard to dimensions and shape, through continuous and adaptive longitudinal grinding or plunge grinding, comprising a measurement device for measuring the dimensions and shape of a workpiece region being ground of a workpiece rotating about a center, comprising:

a) a grinding disc that is mounted in a grinding spindle head and grinds with simultaneous advance in the direction of the X-axis thereof;

b) wherein the measurement device is arranged on the grinding spindle head and is configured such that a sensor can be moved pivotably on a contact region on the workpiece lying in a grinding disc engagement region, in order to be contacted therewith in at least two programmable measurement planes that are spaced apart from one another and arranged transversely to the workpiece central longitudinal axis of the region being ground of the workpiece.

14. The grinding machine according to claim 13, wherein the sensor has two measurement surfaces arranged in the manner of a prism, which contact the workpiece region against the contact region during measurement.

15. The grinding machine according to claim 13, wherein the measurement device can be displaced hydraulically, pneumatically, or electrically.

16. The grinding machine according to claim 13, wherein the measurement device is displaceable on the grinding spindle head under the control of a CNC system.

17. The grinding machine according to claim 13, wherein the grinding disc has a width corresponding to the length of the workpiece region.

18. The grinding machine according to claim 13, wherein the grinding disc has a width (B) that is less than the axial length (L) of the workpiece region, and performs longitudinal grinding along the axis of rotation thereof over the axial longitudinal direction of the workpiece longitudinal direction.

19. The grinding machine according to claim 13, wherein the measurement device measures the dimensions of the respective workpiece region and a conical, crowned, or concave shape can be acquired and produced on the basis of the measured dimensions measurement values.

* * * * *